US008020325B2

(12) United States Patent
Ross et al.

(10) Patent No.: US 8,020,325 B2
(45) Date of Patent: Sep. 20, 2011

(54) POP-UP ARTICLE

(75) Inventors: John Robert Ross, Hoffman Estates, IL (US); Jeffrey T. Stanlaw, Perkasie, PA (US); John Robert Muessig, Ringoes, NJ (US)

(73) Assignee: Vertis, Inc., Baltimore, MD (US)

( * ) Notice: Subject to any disclaimer, the term of this patent is extended or adjusted under 35 U.S.C. 154(b) by 0 days.

(21) Appl. No.: 12/941,316

(22) Filed: Nov. 8, 2010

(65) Prior Publication Data

US 2011/0047839 A1 Mar. 3, 2011

Related U.S. Application Data

(62) Division of application No. 11/881,624, filed on Jul. 27, 2007, now Pat. No. 7,845,099.

(51) Int. Cl.
*G09F 1/00* (2006.01)

(52) U.S. Cl. ..... 40/124.08; 270/41; 446/148

(58) Field of Classification Search ..... 40/124.08; 270/41; 446/148
See application file for complete search history.

(56) References Cited

U.S. PATENT DOCUMENTS 5,230,501 A * 7/1993 Melton ..... 270/41
6,311,418 B1 * 11/2001 Crowell ..... 40/124.08
6,953,513 B1 * 10/2005 Volkert ..... 156/256
7,694,445 B2 * 4/2010 Kelly ..... 40/491

* cited by examiner

*Primary Examiner* — Gary Hoge
(74) *Attorney, Agent, or Firm* — Drinker Biddle & Reath LLP

(57) ABSTRACT

A method for manufacturing a pop-up article from one or more continuous webs of material using an inline printing press. The article comprises a curved or generally semi-cylindrical pop-up device enclosed within a base piece, such that when the base piece is in a closed position, the pop-up device lies flat therein, but when the base piece is moved to an open position, the pop-up device is forced outwardly from the base piece to form a curved or generally semi-cylindrical shape. The method comprises processing a first web or ribbon to define a base piece having a front and back cover, processing a second web or ribbon to define a pop-up device, separating the pop-up device from the second web or ribbon, adhering a tab of the pop-up device to the front cover, adhering a front flap of the pop-up device to the rear cover, and separating the article from the first web or ribbon.

14 Claims, 15 Drawing Sheets

POP-UP ARTICLE

CROSS-REFERENCE TO RELATED APPLICATIONS

This application is a divisional of U.S. patent application Ser. No. 11/881,624 filed on Jul. 27, 2007, which is incorporated by reference herein in its entirety.

FIELD OF THE INVENTION

The present invention relates to a method and apparatus for creating a pop-up article from one or more continuous webs using an inline printing press. The article includes a foldable base piece having a device thereon for forming a curved or semi-cylindrical pop-up.

BACKGROUND OF THE INVENTION

Pop-up articles are particularly useful in advertising. For example, advertising pieces such as brochures, fliers, and direct mailers are well-established media for advertising goods and services. Pop-up articles are also widely used for educational and entertainment purposes, such as in children's books. An essential attribute of such media is that it must attract and hold a viewing person's attention. Therefore, these printed articles are preferably visually appealing to stimulate a person's interesting.

Pop-up articles including pop-up devices that have clever three-dimensional shapes are particularly effective at capturing attention. Typical pop-up devices are enclosed within a foldable base piece having a front cover and a back cover, such that when the base piece is in a closed position, the pop-up device lies flat between the covers, but when the base piece is moved to an open position, the pop-up device is forced outwardly from the base piece to form one or more three-dimensional shapes. However, often such pop-up devices are complex to manufacture, and are therefore impractical to produce on a large scale, because they require manual assembly and/or multiple steps to produce. Accordingly, it is desirable to create an automated method of manufacturing articles including such pop-up devices.

In particular, it is desirable to manufacture a pop-up article including a pop-up device having a curved or generally semi-cylindrical shape when the base piece is opened, such that the pop-up device can be used to simulate a beverage mug or other similar article. However, the manufacture of such a curved or generally semi-cylindrical pop-up device has heretofore been possible only using manual manufacturing techniques, and thus was impractical on a large scale.

In an example, U.S. Pat. No. 3,834,051 (Barnes Jr. et al.) discloses a structural graphic piece, such as a greeting card or folded brochure, having a pop-up device that is substantially flat when the graphic piece is closed but has a distinct curvature when the graphic piece is opened. The distinct curvature may include a right circular cylindrical shape. The pop-up device is actuated by a tab that is fed through an aperture or slit in the pop-up device itself, rendering it impossible to manufacture the disclosed graphic piece from a continuous web using an inline printing press. Additionally, the pop-up device is made from a single piece of material and does not disclose, teach, or suggest adjoining an ornamental feature extending outwardly from an edge of the pop-up device to enable the pop-up device to visually simulate a handle of a beverage mug.

In another example, U.S. Pat. No. 6,192,608 (Williams), along with its counterpart, U.S. Reissue Pat. No. RE38,696

(Williams), discloses a booklet-shaped advertising piece having a pop-up comprising an internal substrate and an anchoring strip, the internal substrate forming a generally semi-cylindrical shape when the advertising piece is opened. The pop-up is actuated by moving a tab at one end of the internal substrate while the anchoring strip prevents an opposite end of the internal substrate from moving. As disclosed, the pop-up spans the entire width of the advertising piece such that the top and bottom edges of the anchoring strip are adhered in proximity to the top and bottom edges of a cover portion of the booklet. Further, when the advertising piece is closed, the tab overlaps a portion of the internal substrate near the fold between the front and back covers of the booklet inhibiting complete closing of the booklet. Additionally, the internal substrate is made from a single piece of material and does not disclose, teach, or suggest adjoining an ornamental feature extending outwardly from an edge of the pop-up device to enable the pop-up to visually simulate a handle of a beverage mug.

Accordingly, it is desirable to provide a pop-up article including a curved or generally semi-cylindrical pop-up device that can be manufactured from one or more continuous webs using an inline printing press. Further, it is desirable to provide a pop-up article including a curved or generally semi-cylindrical pop-up device that can include an ornamental feature to enable the pop-up device to simulate a handle of a beverage mug. Still further, it is desirable to provide a pop-up article including a curved or generally semi-cylindrical pop-up device that can span less than the full width of the pop-up article, and that enables the pop-up article to move between a fully closed position and a fully open position. Yet further, it is desirable to provide an automated method of manufacturing such a pop-up article from one or more continuous webs of material being processed by an inline printing press line.

SUMMARY OF THE INVENTION

Accordingly, the present invention provides a pop-up article comprising a foldable base piece having a curved or generally semi-cylindrical pop-up device therein, and automated methods for producing embodiments of the pop-up article from one or more continuous webs of material being processed by an inline printing press line. A base piece may be made in various configurations including but not limited to a booklet, a card, an advertising insert, a leaflet, and a flier.

The present invention provides methods for making a pop-up article having a curved or generally semi-cylindrical pop-up. A method comprises processing a first web to define a foldable base piece, processing a second web to define a pop-up device, separating an individual pop-up device from the second web, adhering a tab of the pop-up device to a front cover of the base piece, adhering a front flap of the pop-up device to a back cover of the base piece, and separating an individual base piece from the first web. The front cover and the back cover are preferably symmetrically disposed about a fold so that the terms "front cover" and "back cover" are essentially interchangeable herein with regard to the pop-up article and the manufacture thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to embodiment of the present invention, examples of which are illustrated in the accompanying drawings.

Figure 1:
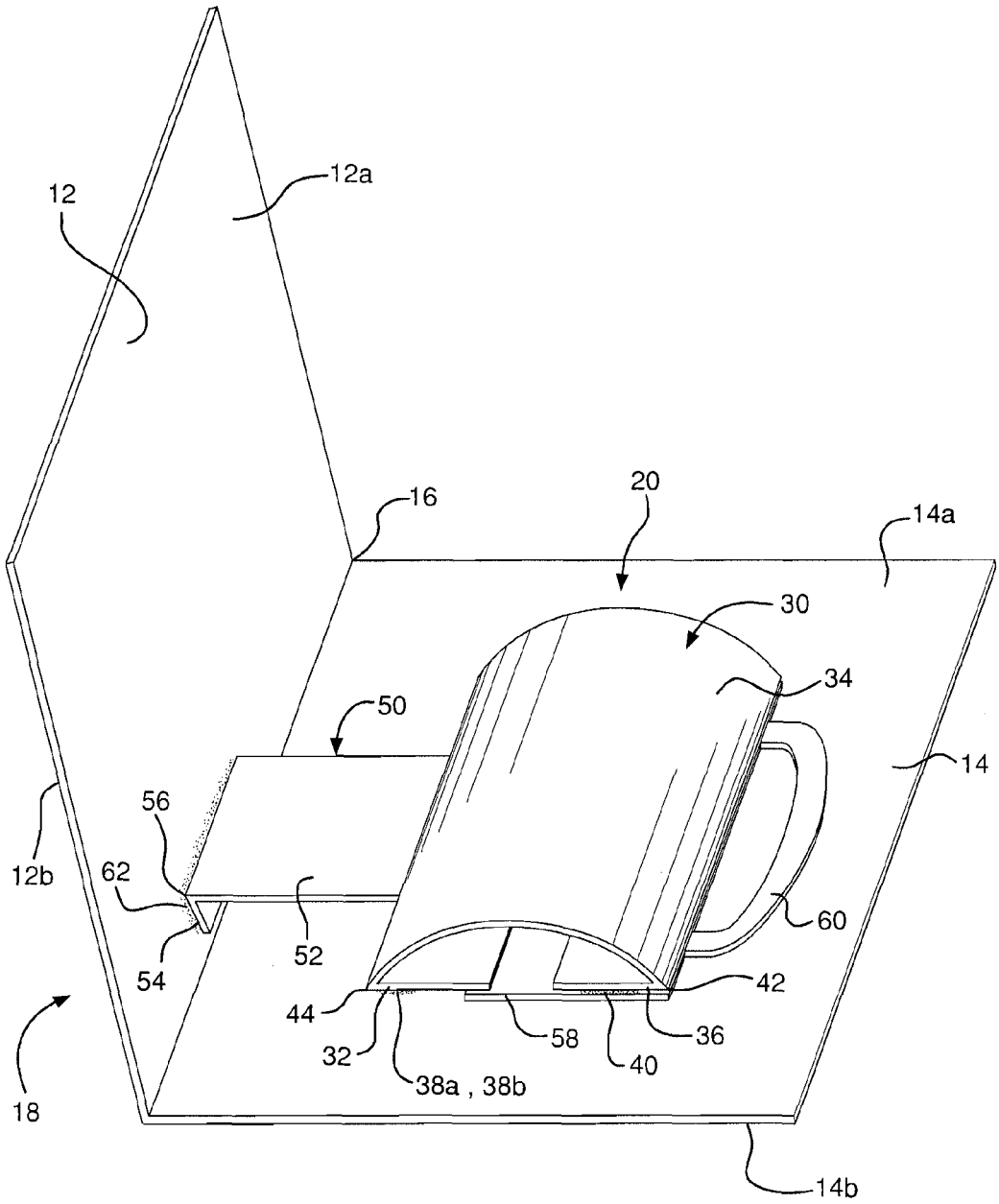
FIG. 1 shows a top perspective view of a pop-up article made by a method of the present invention, in a partially open position.
Figure 1A:
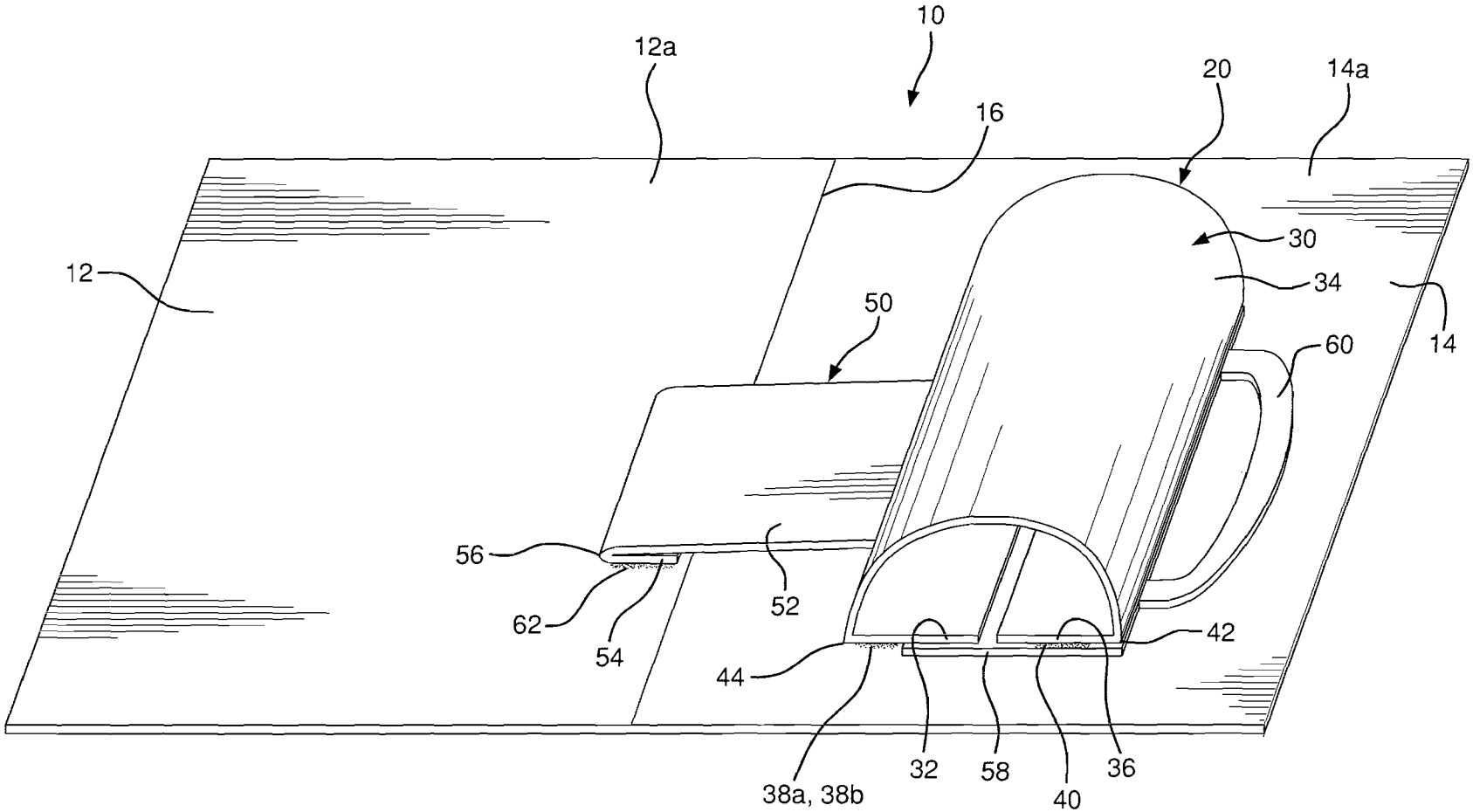
FIG. 1A shows a top perspective view of the pop-up article of FIG. 1, in a fully open position.
Figure 1B:
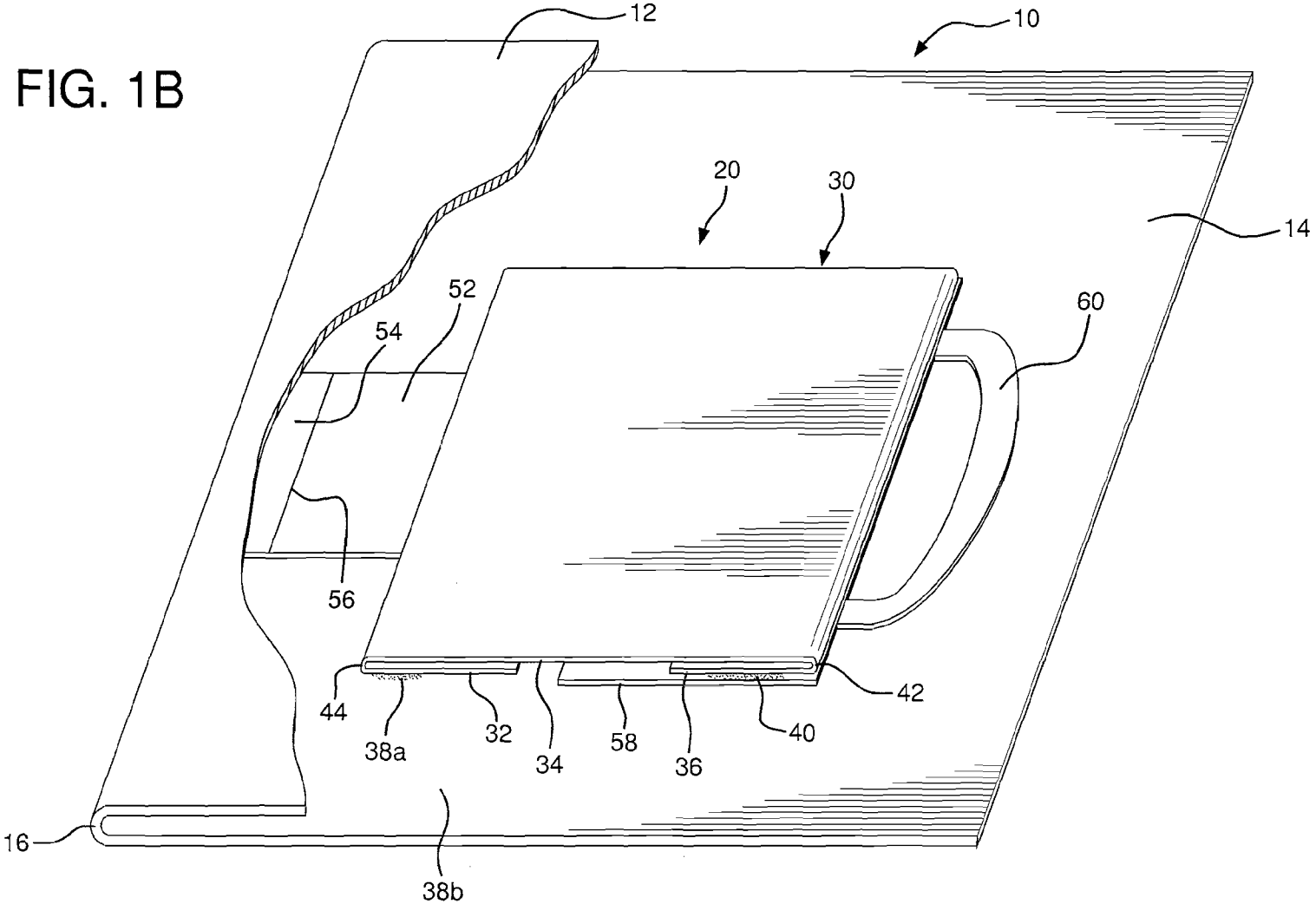
FIG. 1B shows partially cutaway perspective view of the pop-up article of FIG. 1, in a fully closed position.

FIGS. 1 through 1B show an embodiment of a pop-up article 10 made by a method of the present invention. The article 10 comprises a foldable base piece 18 and a pop-up device 20.

The base piece 18 comprises a front cover 12 and a back cover 14 joined together at a fold 16. The front cover 12 has an inside panel 12*a* and an outside panel 12*b*. The inside panel 12*a* and the outside panel 12*b* may be made from separate plies of material, or the front cover 12 may be made from a single ply comprising both the inside panel 12*a* and the outside panel 12*b*. The back cover 14 has an inside panel 14*a* and an outside panel 14*b*. The inside panel 14*a* and the outside panel 14*b* may be made from separate plies of material, or the back cover 14 may be made from a single ply comprising both the inside panel 14*a* and the outside panel 14*b*. When the base piece 18 is in a closed position, the front cover 12 and the back cover 14 are disposed parallel to each other with the inside panel 12*a* facing, and partially in contact with, the inside panel 14*a*. When the base piece 18 is in an open position, the front cover 12 and the back cover 14 are disposed parallel to each other in the same plane, with the inside panels 12*a*, 14*a* disposed generally upward and the outside panels 12*b*, 14*b* disposed generally downward.

In an embodiment, the pop-up device 20 comprises a first member 30 and a second member 50, the first member 30 being fastened to the second member 50 by adhesive or other similar fastener. Each of the first member 30 and the second member 50 may be made from a single ply or from two or more plies of material.

Figure 2:
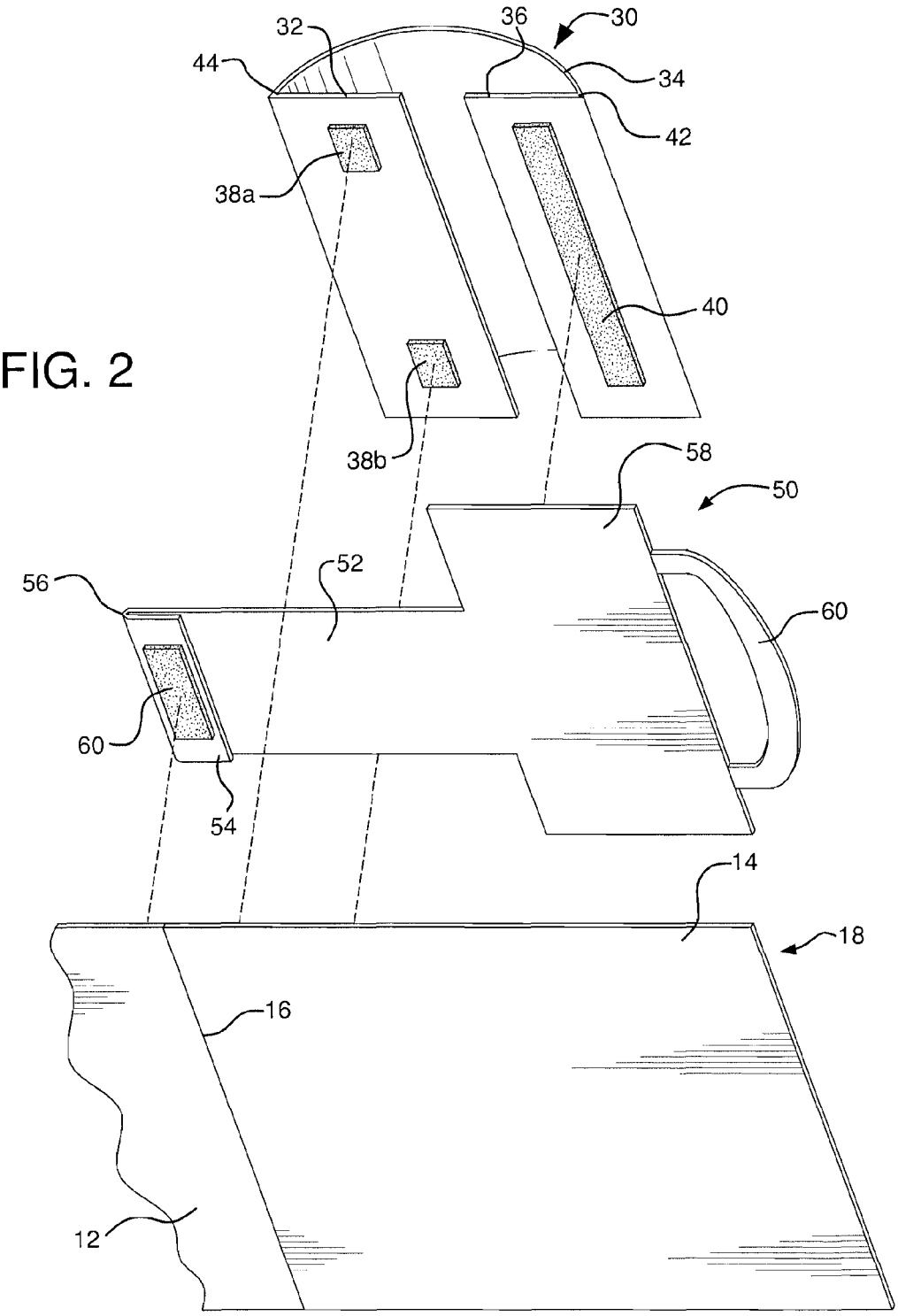
FIG. 2 shows a partially exploded bottom perspective view of the pop-up article of FIG. 1, in a fully open position.
Figure 3:
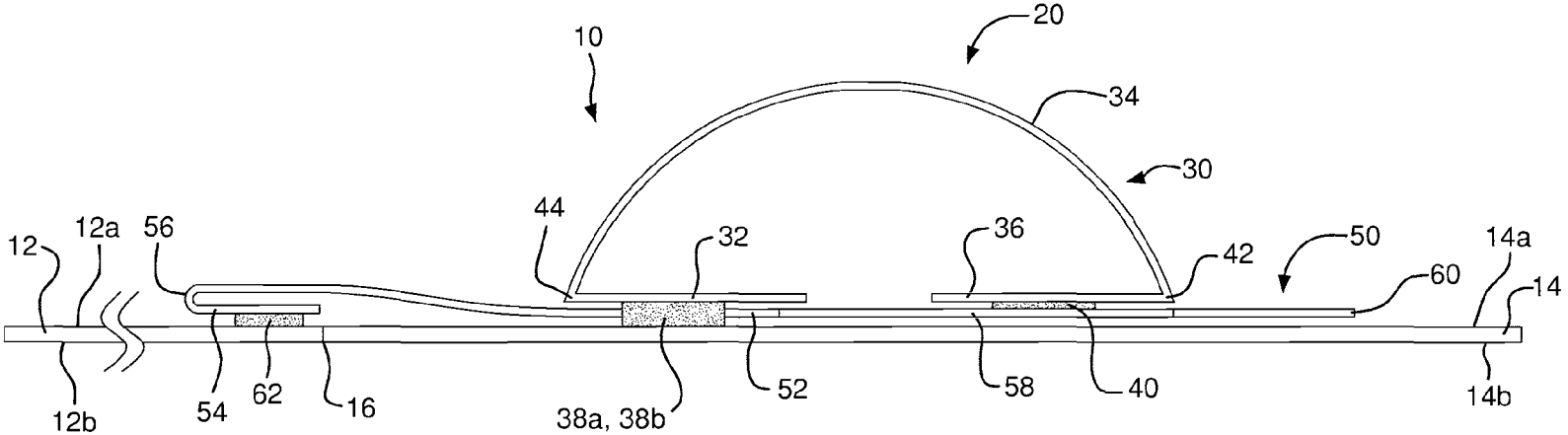
FIG. 3 shows a bottom side view of the pop-up article of FIG. 1, in a fully open position.
Figure 3A:
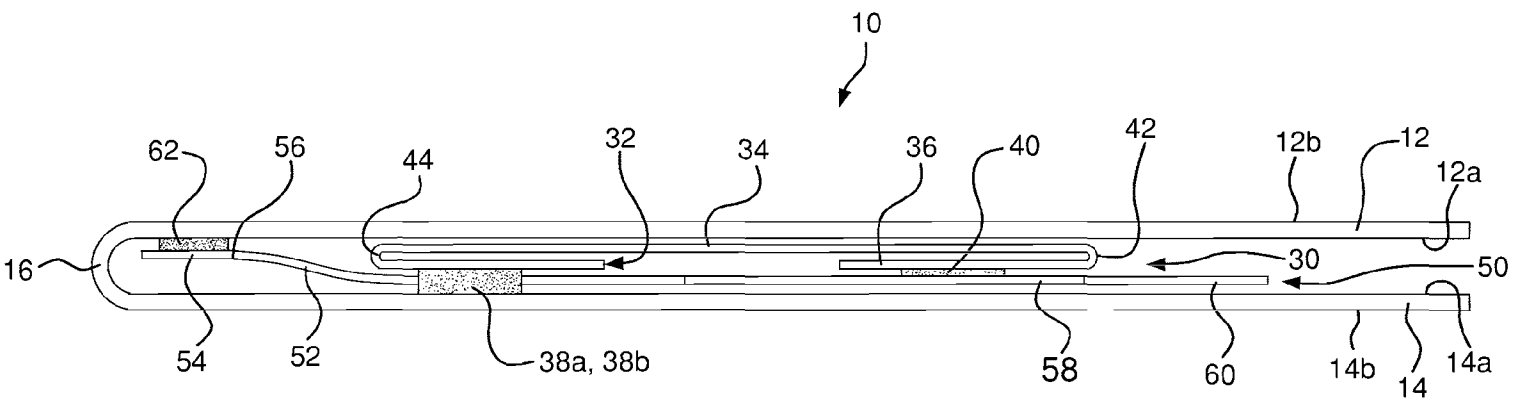
FIG. 3A shows a bottom side view of the pop-up article of FIG. 1, in a fully closed position.
Figure 4:
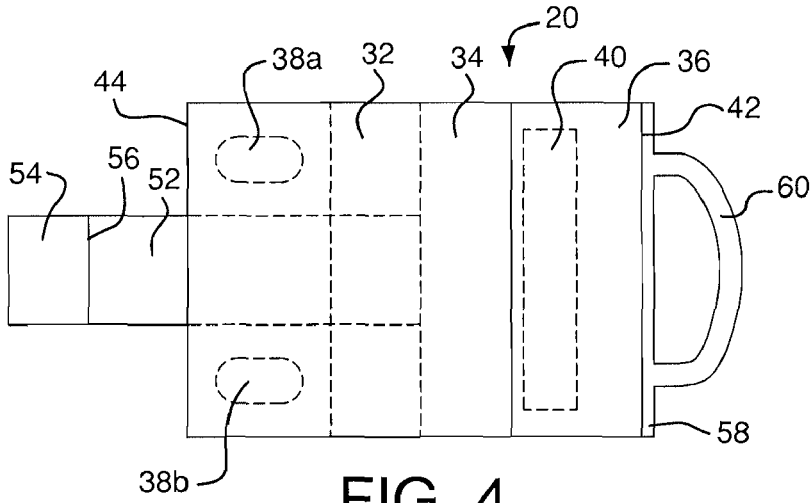
FIG. 4 shows a partially assembled plan view of first and second portions of a pop-up device of the pop-up article of FIG. 1.
Figure 4A:
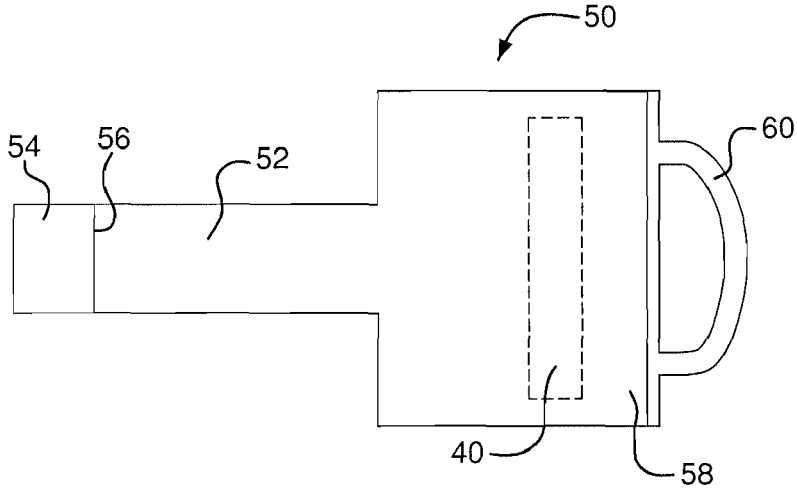
FIG. 4A shows a plan view of a first member of the pop-up device of FIG. 4.
Figure 4B:
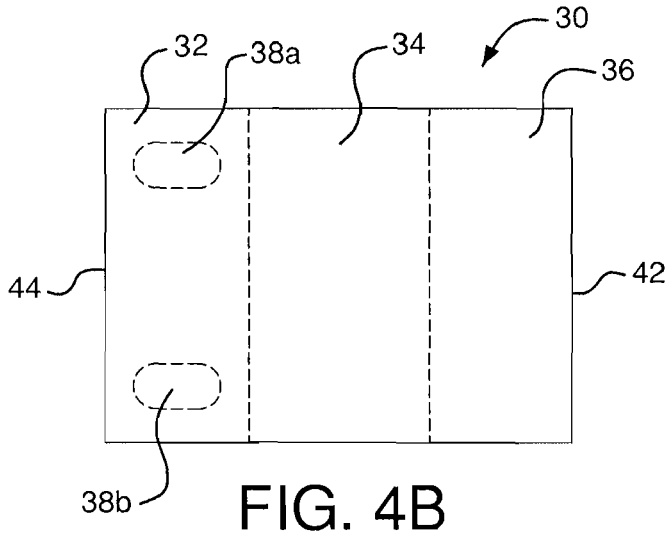
FIG. 4B shows a plan view of a second member of the pop-up device of FIG. 4.

As illustrated in FIGS. 2 through 3A, the first member 30 comprises three sections separated by folds. In particular, the first member 30 comprises a center pop-up panel 34 having one end defined by a fold 44 and an opposite end defined by a fold 42. The pop-up panel 34 is joined to a front flap 32 at the fold 44 and is further joined to a rear flap 36 at the fold 42. When assembled to make the pop-up device 20, the front flap 32 is folded under the pop-up panel 34 at the fold 44 and the rear flap 36 is folded under the pop-up panel 34 at the fold 42. In particular, FIG. 3 shows the pop-up panel 34 forming a curved or generally semi-cylindrical shape when the base piece 18 is in the fully open position, and FIG. 3A shows the pop-up panel 34 flattened against the front flap 32 and the rear flap 36 when the base piece 18 is in the fully closed position. A pair of adhesive beads 38*a*, 38*b* fasten the front flap 32 to the inside panel 14*a* of the back cover 14, while the rear flap 36 is free to move inwardly toward and outwardly away from the front flap 32. FIGS. 1 through 1B, as well as FIGS. 3 through 3A, show that as the rear flap 36 is drawn toward the front flap 32 by opening the base piece 18, the pop-up panel 34 is pushed upwardly away from the back cover 14 and increases in curvature, and as the rear flap 36 is pushed away from the front flap 32 by closing the base piece 18, the pop-up panel 34 is drawn downwardly toward the back cover 14 until the pop-up panel 34 is flat and the rear flap 36 can move no further.

The second member 50 comprises a sliding portion 52, a tab 54, a fastening portion 58, and an optional decorative handle 60. The tab 54 is joined at a fold 56 to an end of the sliding portion 52, and the fastening portion 58 is integrally connected to an opposite end of the sliding portion 52. The decorative handle 60 is connected to or formed as part of the fastening portion 58 and is disposed at an end thereof opposite the junction of the fastening portion 58 with the sliding portion 52. The second member 50 and the first member 30 are preferably, but not necessarily, of approximately the same width. But the sliding portion 52 of the second member 50 must be narrower than the front flap 32 of the first member 30, and hence the sliding portion 52 is narrower than the overall width of the pop-up device 20.

When assembled to make the pop-up device 20, the sliding portion 52 passes between the front flap 32 of the first member 30 and the inside panel 14*a* of the back cover 14, and further passes between the adhesive beads 38*a*, 38*b* affixing the front flap 32 to the back cover 14. A strip of adhesive 62 fastens the tab 54 to the inside panel 12*a* of the front cover 12 near the fold 16, and a strip of adhesive 40 fastens the fastening portion 58 to the rear flap 36 of the first member 30. When the base piece 18 is in the closed position, as shown particularly in FIGS. 1B and 3A, the fold 56 flattens and the tab 54 and sliding portion 52 become aligned. When the base piece 18 is in the open position, as shown particularly in FIGS. 1A and 3, the second member 50 is flexed by about 180 degrees at the fold 56 and the tab 54 is folded under the sliding portion 52 so that the tab 54 is disposed between the sliding portion 52 and the inside panel 12*a* of the front cover 12.

The pop-up device 20 is actuated as follows. When the base piece 18 is in the closed position, the inside panel 12*a* of the front cover 12 faces the inside panel 14*a* of the back cover 14, and the pop-up device 20 is sandwiched between the covers 12, 14 in a flattened state. The first member 30 lies flat with the front flap 32 and rear flap 36 folded underneath the pop-up panel 34. The second member 50 lies flat with the tab 54 and the sliding portion 52 aligned, and with the fastening portion 58 and part of the sliding portion 52 disposed between the first member 30 and the back cover 14. The tab 54 is affixed to the inside panel 12*a* of the front cover 12 near the fold line 16 by the adhesive strip 62, the fastening portion 58 of the second member 50 is affixed to the rear flap 36 of the first member 30 by the adhesive strip 40, and the front flap 32 of the first member 30 is affixed to the inside panel 14*a* of the back cover 14 by the pair of adhesive beads 38*a*, 38*b* disposed on either side of the sliding portion 52 of the second member 50.

When the base piece 18 is moved from the closed position to the open position, the front cover 12 is pivoted away from the back cover 14 about the fold 16. The tab 54 moves away from the back cover 14 in conjunction with the front cover 12, pulling the sliding portion 52, and hence the fastening portion 58, inwardly toward the fold 16 at the junction of the front cover 12 and the back cover 14. Because the fastening portion 58 is fastened to the rear flap 36 of the first member 30, the rear flap 36 is drawn inwardly toward the front flap 32. However, because the front flap 32 is anchored to the back cover 14 by the adhesive beads 38*a*, 38*b*, the front flap 32 remains fixed with respect to the back cover 14. As the rear flap 36 approaches the front flap 32, the distance between the ends of the pop-up panel 34, as defined by the folds 42, 44, becomes shorter than the pop-up panel 34 itself and the pop-up panel 34 is forced to curve to accommodate the closer location of its ends. When the base piece 18 reaches the fully open position, the sliding portion 52, and hence the rear flap 36, stops moving and the pop-up panel 34 is held in a curved shape generally resembling a semi-cylinder. Hence, the location of the adhesive strips 40, 62 and the adhesive beads 38*a*, 38*b* govern the relative movement of the parts of the article 10 with respect to each other as the base piece 18 is moved between the open and closed positions.

It can be readily seen that the distance of travel of the sliding portion 52, and hence the distance of travel of the rear flap 36 and the fold 42, is approximately twice the distance between the fold 16 and the fold 56. The distance of travel can be adjusted according to the size of the pop-up panel 34 and the desired final curvature of the pop-up panel 34. The distance of travel may be increased or decreased by respectively increasing or decreasing the distance between the folds 16, 56, which is determined by the size and placement of the tab 54 with respect to the fold 16 when the tab 54 is adhered to the front cover 12. Thus, for the same size pop-up panel 34, a smaller radius of curvature (i.e., a steeper pop-up effect) can be achieved by using a longer distance of travel, and a larger radius of curvature (i.e., a shallower pop-up effect) can be achieved by using a shorter distance of travel. Alternatively, a differently sized pop-up panel 34 may be actuated to the same degree of curvature by selecting a distance between the folds 16, 56 that is proportional to the distance between the fold lines 42, 44 defining the ends of the particular pop-up panel 34.

In another embodiment, as shown in FIGS. 9 through 11C, a pop-up device 120 can be made using a single member 130. In particular, the member 130 has a center pop-up panel 134 having one end defined by a fold 144 and an opposite end defined by a fold 142. The pop-up panel 134 is joined to a front flap 132 at the fold 144 and is further joined to a rear flap 136 at the fold 142. The rear flap 136 supports a sliding portion 152 having a tab 154 joined thereto at a fold 156, the tab 154 being disposed at a distal end of the sliding portion 152 away from the fold 142. The sliding portion 152 is narrower than the front flap 132.

When the member 130 is assembled to the base piece 18 to make the pop-up device 120, the front flap 132 is folded under the pop-up panel 134 at the fold 144 and the rear flap 136 is folded under the pop-up panel 134 at the fold 142. The sliding portion 152 passes between the front flap 132 and the back cover 14, and further passes between adhesive beads 138*a*, 138*b* adhering the front flap 132 to the back cover 14. A strip of adhesive 162 fastens the tab 154 to the front cover 12 near the fold 16. When the base piece 18 is in the closed position, as shown particularly in FIG. 10A, the fold 156 flattens and the tab 154 and sliding portion 152 become aligned. The pop-up panel 134 forms a flat shape and the pop-up device 20 is disposed between the front and back covers 12, 14. When the base piece 18 is in the open position, as shown particularly in FIG. 10, the fold 156 is flexed by about 180 degrees and the tab 154 is folded under the sliding portion 152 so that the tab 154 is disposed between the sliding portion 152 and the front cover 12. The pop-up panel 134 forms a curved or generally semi-cylindrical shape and the front and back covers 12, 14 are aligned in a generally coplanar manner.

Figure 5:
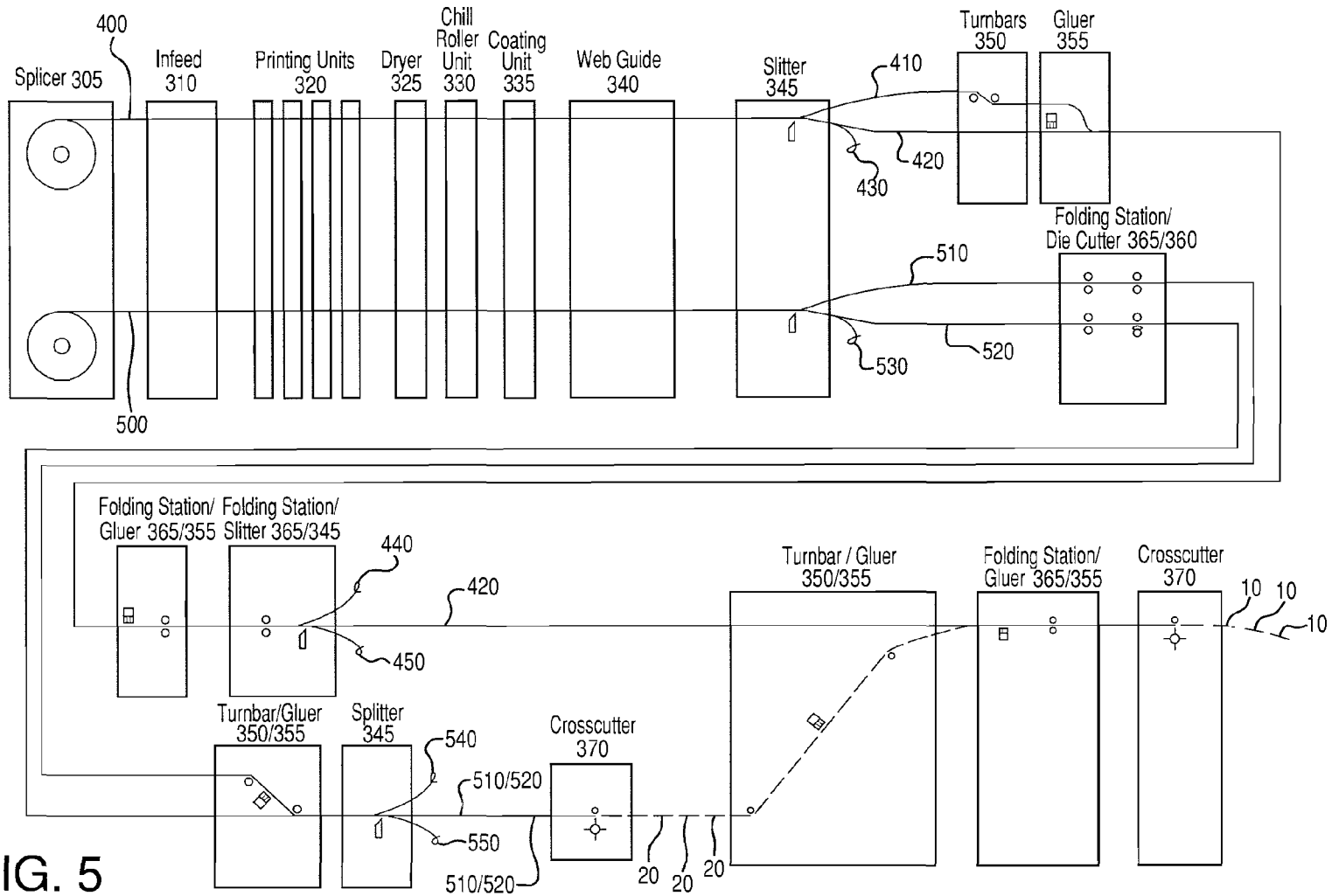
FIG. 5 shows a schematic block diagram of an inline printing press line of the present invention.

FIG. 5 shows a schematic block diagram of an inline printing press line 300 for performing a method of the present invention. An inline press line 300 typically includes a splicer 305, an infeed 310, one or more printing units 320, a dryer 325, a chill roller unit 330, a coating unit 335, one or more web guides 340, one or more slitters 345, one or more ribbon turnbars 350, one or more gluers 355, one or more die cutters 360, one or more folding stations 365, and one or more cross cutters 370. Further, several of the above mentioned component devices may be provided in combination; for example, a turnbar and gluer may be provided in the same turnbar gluer device, and a folding station may include one or more of a slitter, a gluer, and a die cutter.

A method for manufacturing a pop-up article 10 having a curved or generally semi-cylindrical pop-up panel is described as follows, with reference to the schematic of FIG. 5 and the method steps shown in FIGS. 6 through 8B. Although a specific sequence of method steps for making the article 10 is described herein, it is readily apparent that several of the various steps may be performed either concurrently or sequentially, and that the order of the various steps may be modified, without departing from the nature and spirit of the invention.

In the depicted method, the pop-up article 10 is manufactured on an inline printing press line 300 from two webs of material. Alternatively, the pop-up article 10 can be made from a single web. A web material is provided on a roll held by a splicer 305 and can include various weight substrates such as paper or other medium capable of being printed, slit, folded, glued, die cut, and otherwise processed by the component equipment of a printing press line 300.

Figure 6:
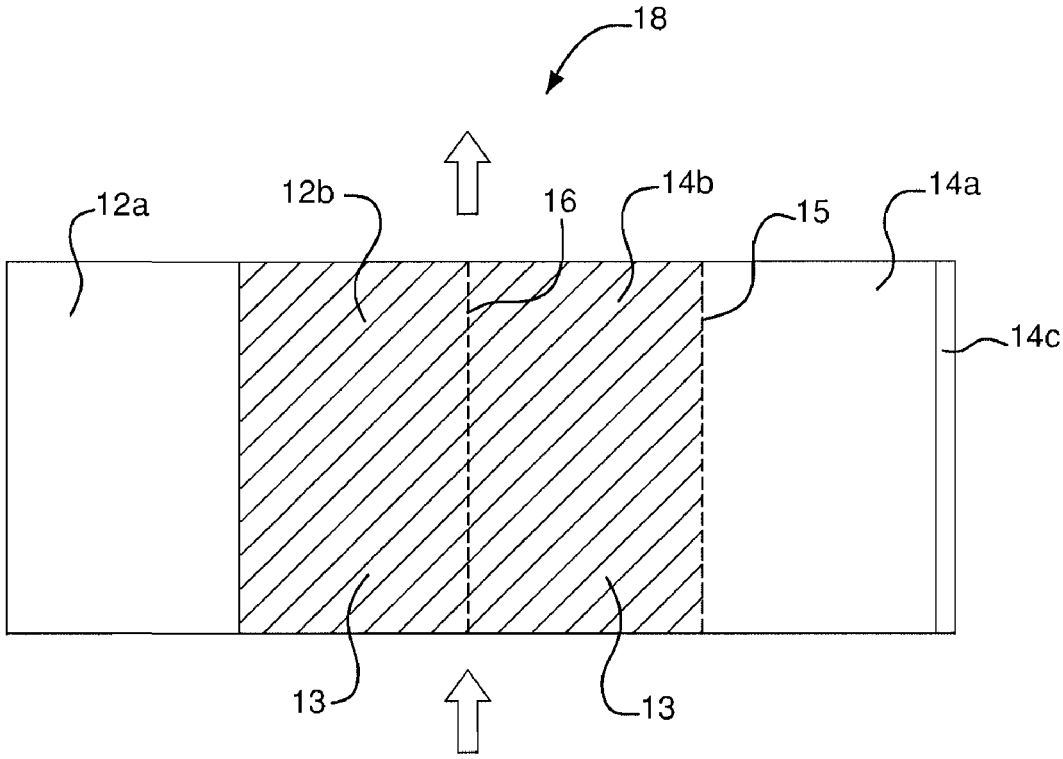
FIG. 6 shows a plan view of a first web for making a base piece of the pop-up article of FIG. 1, indicating generally the location of slits, folds, and adhesive.
Figure 6A:
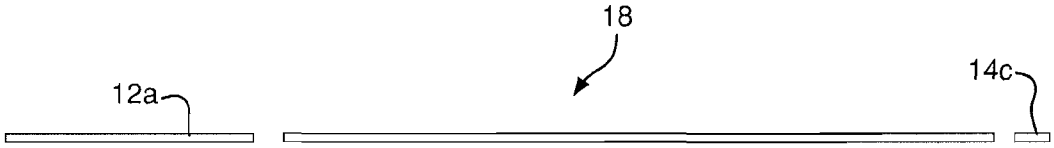
FIGS. 6A-6D show bottom end views of sequential method steps for making a base piece from the web of FIG. 6.
Figure 6B:
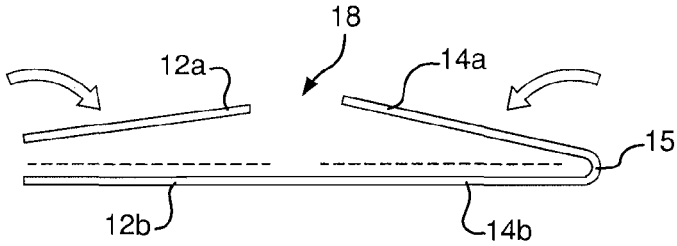
Figure 6C:
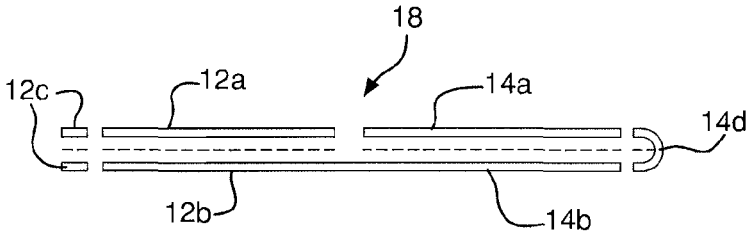
Figure 6D:
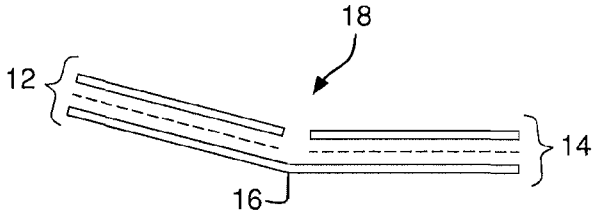
Figure 7:
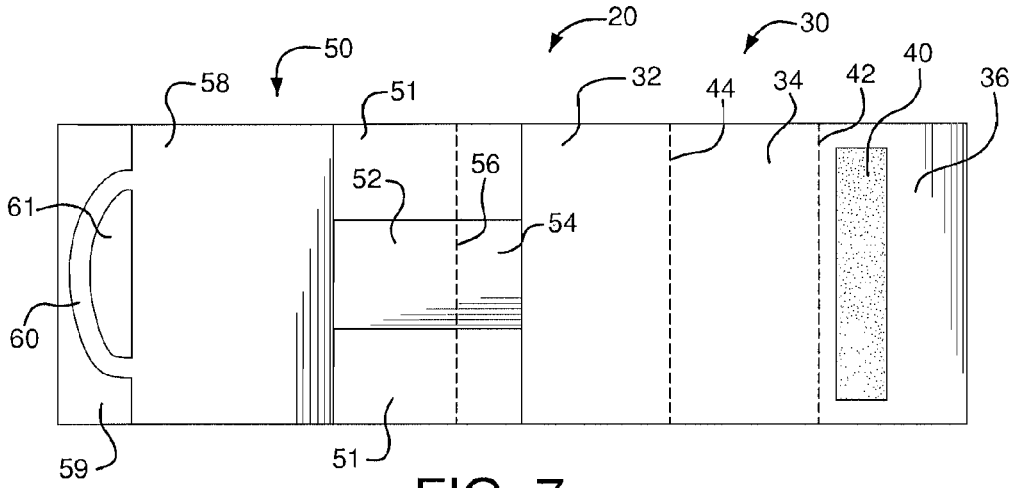
FIG. 7 shows a plan view of a second web for making a pop-up device of the pop-up article of FIG. 1, indicating generally the location of slits, folds, die cuts, and adhesive.
Figure 7A:
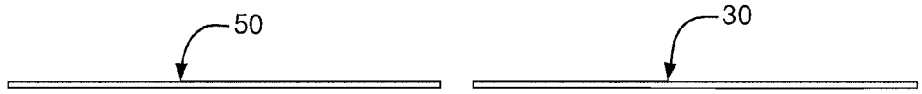
FIGS. 7A-7D show bottom end views of sequential method steps for making a pop-up device from the web of FIG. 7.
Figure 7B:
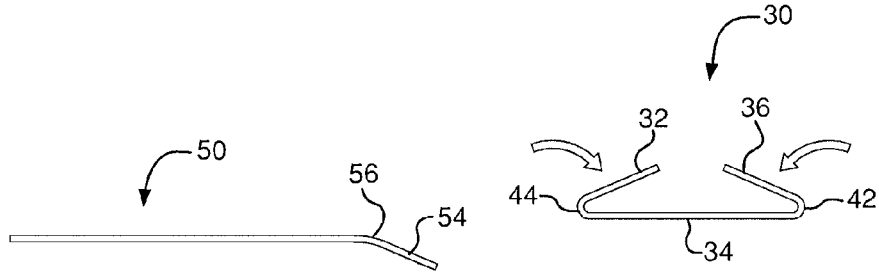
Figure 7C:
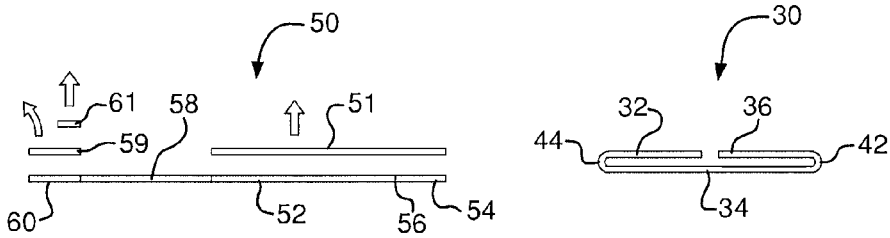
Figure 7D:
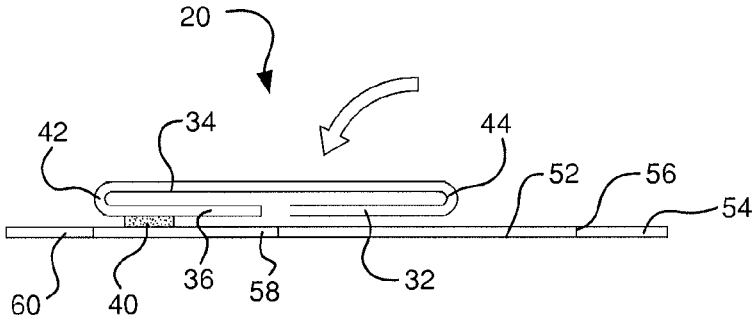
Figure 8:
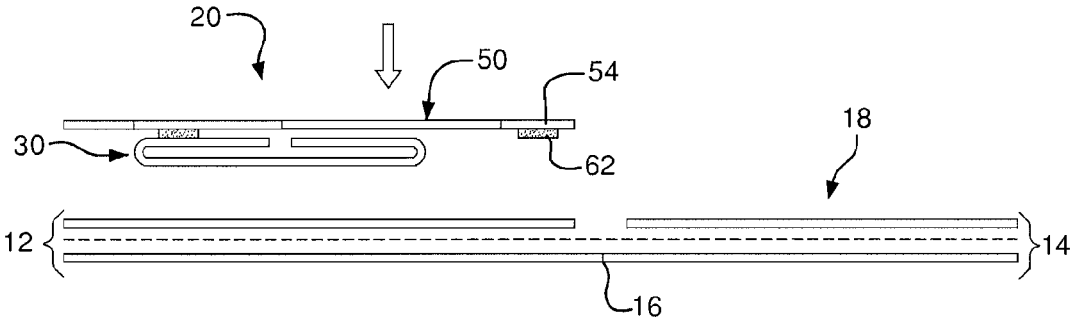
FIG. 8 shows a bottom end view of a ribbon for making the pop-up device of FIGS. 7-7D aligned for assembly to a ribbon for making the base piece of FIGS. 6-6D.
Figure 8A:
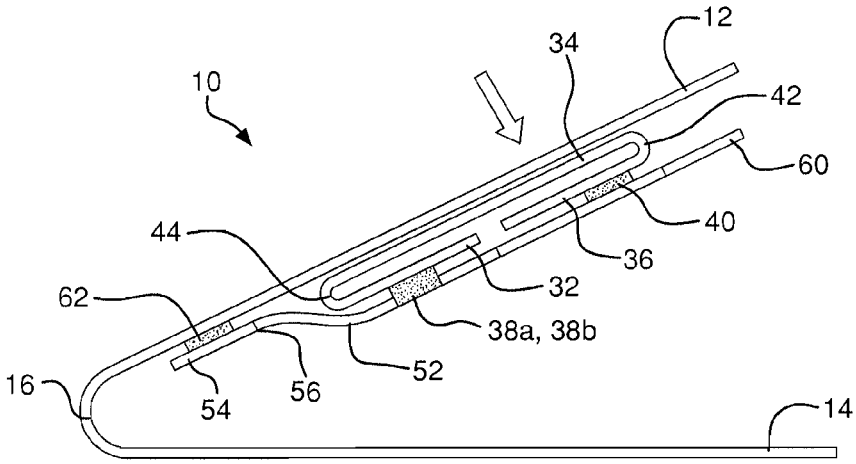
FIG. 8A shows a bottom end view of a method step for assembling a pop-up device onto a base piece.
Figure 8B:
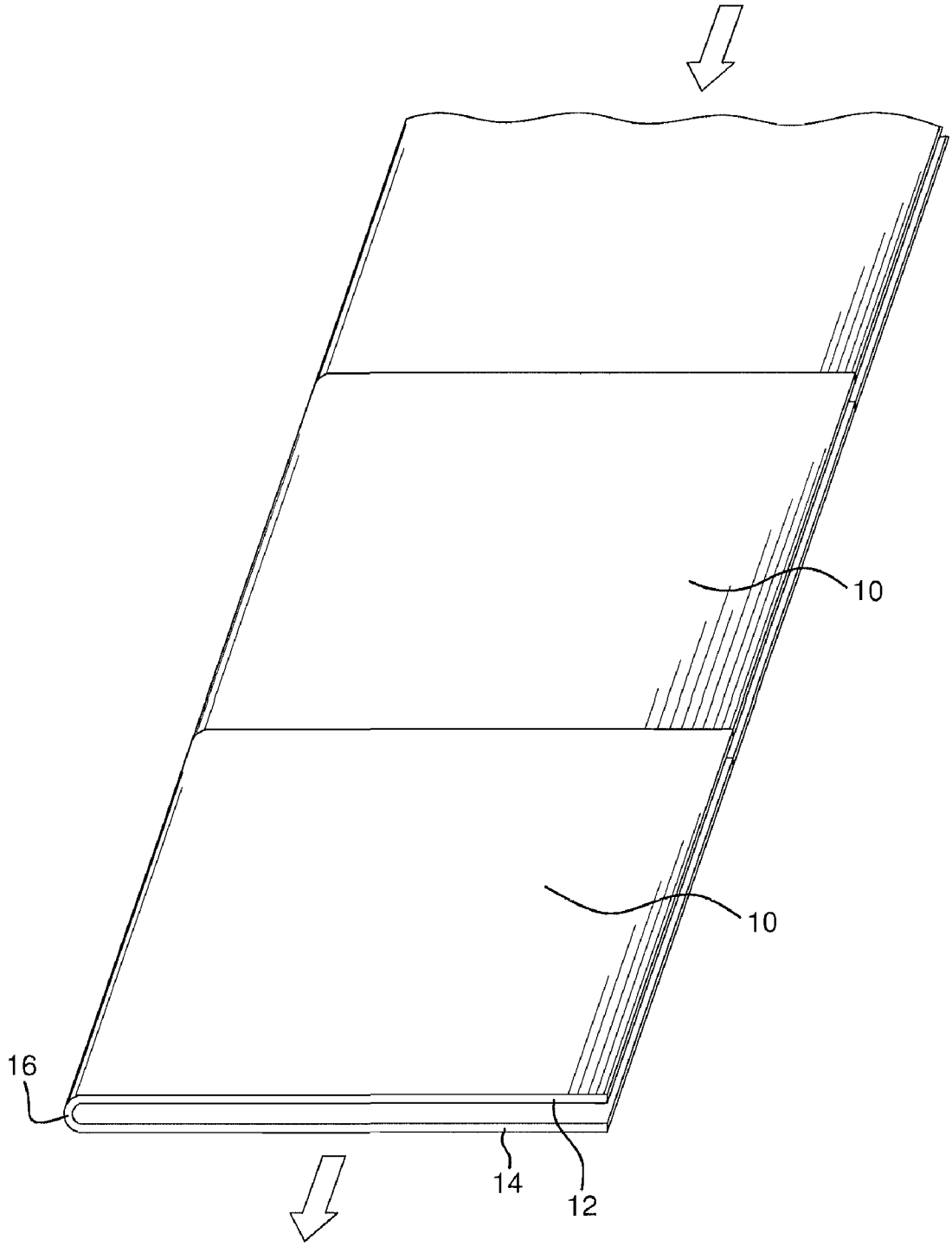
FIG. 8B shows a perspective view of a method step for separating an individual pop-up article from a ribbon.

The base piece 18 is made by processing a first web, as depicted schematically in FIGS. 6 through 6D, and the pop-up device 20 is made by processing a second web, as depicted schematically in FIGS. 7 through 7D. Processing may include, but is not limited to, any combination of process steps such as slitting, folding, adhering, rotating, die cutting, cross cutting, printing, drying, chilling, and coating. The pop-up device 20 is secured to the base piece 18, as depicted in FIGS. 8 through 8A, to enable the pop-up panel 34 to lie flat when the base piece 18 is closed and to further enable the pop-up panel 34 to be transformed into a curved or generally semi-cylindrical shape projecting upwardly from the back cover 14 when the base piece 18 is opened. Finally, individual pop-up articles 10 are separated from the second web as depicted in FIG. 18B. Processing operations are performed on the first web and the second web in parallel synchronization, until the various parts are joined onto a single web or ribbon that then is cut apart perpendicularly to the direction of travel of the web or ribbon into individual articles 10. Each web and/or ribbon may be routed at a different speed and through a different distance to accommodate for differences in the longitudinal dimensions between the base piece 18 and the pop-up device 20 and their respective constituent parts, and to make sure that the respective parts of the article 10 are in register when they are joined together. In an alternate method, a pop-up article 10 may be manufactured from two or more ribbons slit from one web of material, rather than from separate webs.

FIG. 6 generally depicts an overview of the processing operations to be performed on the first web to make the base piece 18 having two-ply covers 12, 14. A base piece 18 having single-ply covers 12, 14, or covers 12, 14 made from three or more plies, may be made by removing or adding slitting, folding, and gluing operations, as required. In describing the processing operations for making the base piece 18, reference is made to the schematic of FIG. 5 as well as the sequential depictions of FIGS. 6A through 6D.

A first web 400 is fed from a splicer 305 through an infeed 310. An inline printing press line 300 may have more than one splicer 305, particularly if two or more webs are being processed in parallel. The splicer 305 maintains a continuous feed of paper to the printing press line 300 by splicing a new web to the web being processed when the web being processed reaches the end of its roll. The splicer 305 supplies the web to the infeed 310. The infeed 310 controls the feeding of the web to one or more printing units 320. The infeed 310 may further include tension control devices to control the tension in the web.

The first web 400 is fed through the infeed 310 into a printing unit 320, where printing can be applied to one or both sides of the web. The printing unit 320 is capable of applying printing that is the same from piece to piece. The printing unit 320 is further capable of applying printing that is customized so that each article 10 can be different, such as by having a different mailing address. The quantity of printing units 320 may vary according to the number of colors desired on the web. The schematic diagram of FIG. 5 shows four printing units 320, each printing unit 320 being capable of printing using a different color ink, so that a pop-up article may be created having as many as four colors. A printing press line 300 typically can have as many as seven or more printing units 320 for printing color articles having seven or more colors; if less than seven colors are desired, the web can pass through one or more of the printing units 320 without being printed. In addition, each printing unit 320 typically includes upper and lower printing equipment for printing on both sides of the web as the web makes a single pass through the printing unit 320.

Next, if heat set inks have been used in the printing units 320, the web 400 typically passes through a dryer 325, which uses heat to remove solvents and oils from the ink applied to the web by the printing units 320, leaving only the pigment and resin from the ink on the web. To set the pigment after the print has been dried in the dryer 325, the web is typically then run through a chill roll unit 330. In an embodiment, the chill rollers have 65 degree water running therethrough, which shocks the resin and sets the pigment to the web. Heat set inks are typically used with lithographic printing. Alternatively, ultraviolet curable inks can be used, or a web can be printed using only inkjet printing that does not require heat setting.

Next, the web 400 may enter a coating unit 335 for applying an over-print varnish or other coating on top of the print. A coating unit 335 can be located at any point in the printing press line 300 before the web is slit into two or more ribbons. Varnish or coating may be applied to all or only part of the web. The coating unit 335 can apply to the web a thin film of varnish or ultraviolet protective coating to protect the print. The coating unit 335 can also apply a thin film of silicone mixed with water to add back moisture that was removed by the dryer 325.

After the first web 400 has been printed, dried, and coated, it is positioned by a web guide 340 so that it may be subjected to processing operations including slitting, folding, gluing, and die cutting, as required to make the base piece 18. Web guides 340 may be used anywhere along the press line 300 to help maintain the proper direction of a web or a ribbon slit from a web. For example, a web guide 340 can be used to position the web between one apparatus and another, a web guide 340 can be used to position the web for slitting into two or more ribbons, and a web guide 340 can also be used to position two or more ribbons relative to each other for overlaying and gluing.

As shown in FIGS. 5 and 6A, a ribbon 410 for making the front cover inside panel 12*a* is slit away from the first web 400, leaving a remaining ribbon 420. Also, any unneeded material may be trimmed from the edge of the web 400, as for example a ribbon 430 (portion 14*c*) is trimmed away from the remaining ribbon and discarded. A slitter 345 cuts the web 400 longitudinally along the direction of travel of the web as the web moves through the slitter 345, so that the two ribbons 410, 420 continue to move in parallel through the press line 300.

As shown in FIGS. 5 and 6B, the ribbon 410 for making the panel 12*a* is rotated by a set of ribbon turnbars 350 to be in register with a portion of the remaining ribbon 420 for making the panel 12*b*. One or more ribbon turnbars 350 can be used at various positions in the press line 300 for positioning ribbons with respect to each other so that they be married or adhered together, as required. Next, a white glue adhesive 13 is applied by a gluer 355 to the portion of the remaining ribbon 420 for making the panel 12*b*, and the panels 12*a* and 12*b* are adhered together to create a laminated front cover 12. A gluer 355 can be used at various positions in the press line 300 to selectively apply adhesive to all, or any part of, a ribbon passing through. It should also be noted that the ribbon turnbars 350 and the gluer 355 need not be separate pieces of equipment, and indeed often these functions are combined in a ribbon turnbar gluer. Entire ribbons may be married or glued together, as with the panels 12*a* or 12*b*, or portions of one or more ribbons may be married or glued together. Various adhesives may be used, including but not limited to permanent adhesives, one-time removable adhesives, low tack repositionable hot melt glues or fugitive glues, or low tack pressure sensitive adhesives that allow for repositionable movement. Specifically with regard to creating the laminated front cover 12, a permanent adhesive is preferably used.

Additionally, a white glue adhesive 13 is applied by a gluer 355 to a portion of the remaining ribbon 420 for making the panel 14*b*. A portion of the remaining ribbon 420 for making the panel 14*a* is folded over by a folding station 365 by creating a fold 15 so that the portion of the ribbon 420 for making the panel 14*a* is in register with the portion of the remaining ribbon 420 for making the panel 14*b*, and the panels 14*a* and 14*b* are adhered together to create a laminated back cover 14. The folding station 365 folds a web or a ribbon in the longitudinal direction along the direction of travel of the web as the web or the ribbon moves through the folding station 365. If heavier weight laminated covers are not required, the lamination operation steps can be skipped and the panels 12*b*, 14*b* can suffice as the front and back covers 12, 14, respectively.

Also, it is readily apparent that a ribbon for making the panel 14*a* could be slit away from the web 400 and glued as a separate ribbon onto the portion of the remaining ribbon 420 for making the panel 14*b*, in the same manner as the ribbon 410 was slit away, rotated, and glued for creating the laminated front cover 12 from the panel 12*a* married to the panel 12*b*. It is likewise readily apparent that a laminated front cover 12 could be created without slitting a separate ribbon 410 from the web 400 by instead folding over a portion of the web for making the panel 12*a* to be in register with a portion of the web for making the panel 12*b* and gluing the panels 12*a* and 12*b* together, in the same manner as described above with regard to creating the laminated back cover 14.

As shown in FIGS. 5 and 6C, the base piece 18 defined by the married ribbons 410, 420 may be trimmed. For example, the front cover 12 may be trimmed to remove a ribbon of excess material 440 (portion 12*c*), and the back cover 14 may be trimmed to remove a ribbon of excess material 450 (portion 14*d*). Additionally, as shown in FIGS. 5 and 6D, a fold 16 is created by a folding station 365 to form the spine of the base piece 18, the fold 16 delineating the front cover 12 from the back cover 14. Several various functions can commonly be combined into a single machine that may be generally denoted as a folding station 365. Accordingly, a folding station 365 can include one or more slitters, one or more gluers, one or more ribbon turnbars, and various other devices as required, so that the ribbon need not necessarily pass into separate components or pieces of equipment to perform each processing operation such as slitting, gluing, or turning that is described herein as occurring before, after, or simultaneously with a folding operation.

FIG. 7 generally depicts an overview of the processing operations to be performed on the second web 500 to make the pop-up device 20. As described above with regard to processing of the first web 400, the second web 500 is fed from a splicer 305 through an infeed 310 into one or more printing units 320. The print on the second web 500 is dried by a dryer 325 and the pigment is set by a chill roll unit 330, and varnish may be applied as desired by a coating unit 335. As noted with regard to the first web 400, if a non-heat set ink is used, the heat drying and subsequent chilling processes will not be required. The web 500 is guided for further processing by one or more web guides 340. In describing the processing operations for making the pop-up device 20, reference is made to the schematic of FIG. 5 as well as the sequential depictions of FIGS. 7A through 7D.

As shown in FIGS. 5 and 7A, the web 500 is slit apart by a slitter 345 into a ribbon 510 for making the first member 30 and a ribbon 520 for making the second member 50. Any excess material may be trimmed from the web, as for example a ribbon 530 (portion 53) is trimmed away and discarded. The ribbon 510 for making the first member 30 and the ribbon 520 for making the second member 50 are processed in parallel synchronization, and the movement of the ribbons 510, 520 may be adjusted as required by various turnbars 350.

As shown in FIGS. 5 and 7B, the ribbon 510 is folded in two places by a folding station 365 to create a fold 42 delineating a pop-up portion 34 and a rear flap 36, and to create a fold 44 delineating the pop-up portion 34 and a front flap 32. At the same time, the ribbon 520 is folded by the folding station 365 to create a fold 56 between a tab 54 and a sliding portion 52.

As shown in FIGS. 5 and 7C, a die cutter 360 is used to repeatedly chip pieces 51 from the ribbon 520 to create sliding portions 52 at intervals corresponding to individual second members 50, such that the width of each sliding portion 52 is less than the width of an individual second member 50 and the width of each fastening portion 58 is no greater than the width of an individual second member 50. The die cutter 360 is further used to chip pieces 59 and 61 from the ribbon 520 corresponding to individual second members 50 to create the ornamental handle feature 60 on each second member 50. Because the handle 60 is ornamental and not functional, any shape, or no shape, could as easily be created in its place. The die cutter 360 is used to cut out complex shapes from a ribbon as the ribbon passes through the die cutter 360, including shapes having borders that are not parallel to the direction of travel of the ribbon. Typically, a die is disposed on a cylinder over which the ribbon passes, and as the ribbon is pressed against the cylinder, the die cuts a shape into the ribbon. The die cutter 360 can cut edges of shapes completely through the ribbon, or can cut perforated edges of shapes to enable the shape to be later torn away. The die cutter 360 can also cut perforated edges parallel to or off-parallel from the direction of travel of the ribbon, and such perforated edges can delineate fold lines to enable easier folding of a ribbon along such fold lines.

As shown in FIGS. 5 and 7D, a strip of adhesive 40 is applied by a gluer 355 to a surface of the ribbon 510 corresponding to the rear flap 36, in preparation for gluing the ribbons 510, 520 together. The ribbon 510 is rotated by a turnbar 350 to be in register with the ribbon 520, and the rear flap 36 is adhered to the fastening portion 58 of the second member 50 so that the fold 42 is substantially aligned with the junction of the handle 60 and the fastening portion 58. Additionally, the married ribbons 510, 520 for making the pop-up device may be trimmed. For example, excess edge material may be removed as ribbons 540, 550. Lastly, the married ribbons 510, 520 are severed by a crosscutter 370 to cut the pop-up devices 20 down to finished size and to separate the individual pop-up devices 20 for synchronization and mating with corresponding base pieces 18.

FIGS. 5, 8, and 8A illustrate the mating of the pop-up devices 20 made from the second web 500 with the base pieces 18 made from the first web 400. First, in a turnbar gluer 350/355, each pop-up device 20 is rotated to be in register with the ribbon 420 containing a corresponding base piece 18, and a strip of adhesive 62 is applied to the tab 54. The tab 54 of the pop-up device 20 is adhered to the front cover 12 near the fold line 16, creating an anchor for actuating the sliding portion 52 of the pop-up device 20. Next, in a folding station and gluer 365/355, two beads of adhesive 38*a*, 38*b* are applied to the front flap 32 disposed on either side of the sliding portion 52. The back cover 14 is folded over onto the front cover 12 at the fold 16, causing the front flap 32 to be adhered to the back cover 14 by the adhesive beads 38*a*, 38*b*. Adhering the front flap 32 to the back cover 14 in this manner creates an anchor for an end of the first member 30 so that when an opposite end of the first member 30 is actuated by the sliding portion 52, the pop-up panel 34 will be pushed upwardly from the back cover 14 into a curved or generally semi-cylindrical shape. Finally, after the pop-up device 20 has been assembled to the second web 500 containing a corresponding base piece 18, the individual articles 10 are severed from the web 500 by a crosscutter 370, which cuts the base piece 18 to finished size and separates the individual base pieces 18 from each other to make the completed articles 10.

Figure 9:
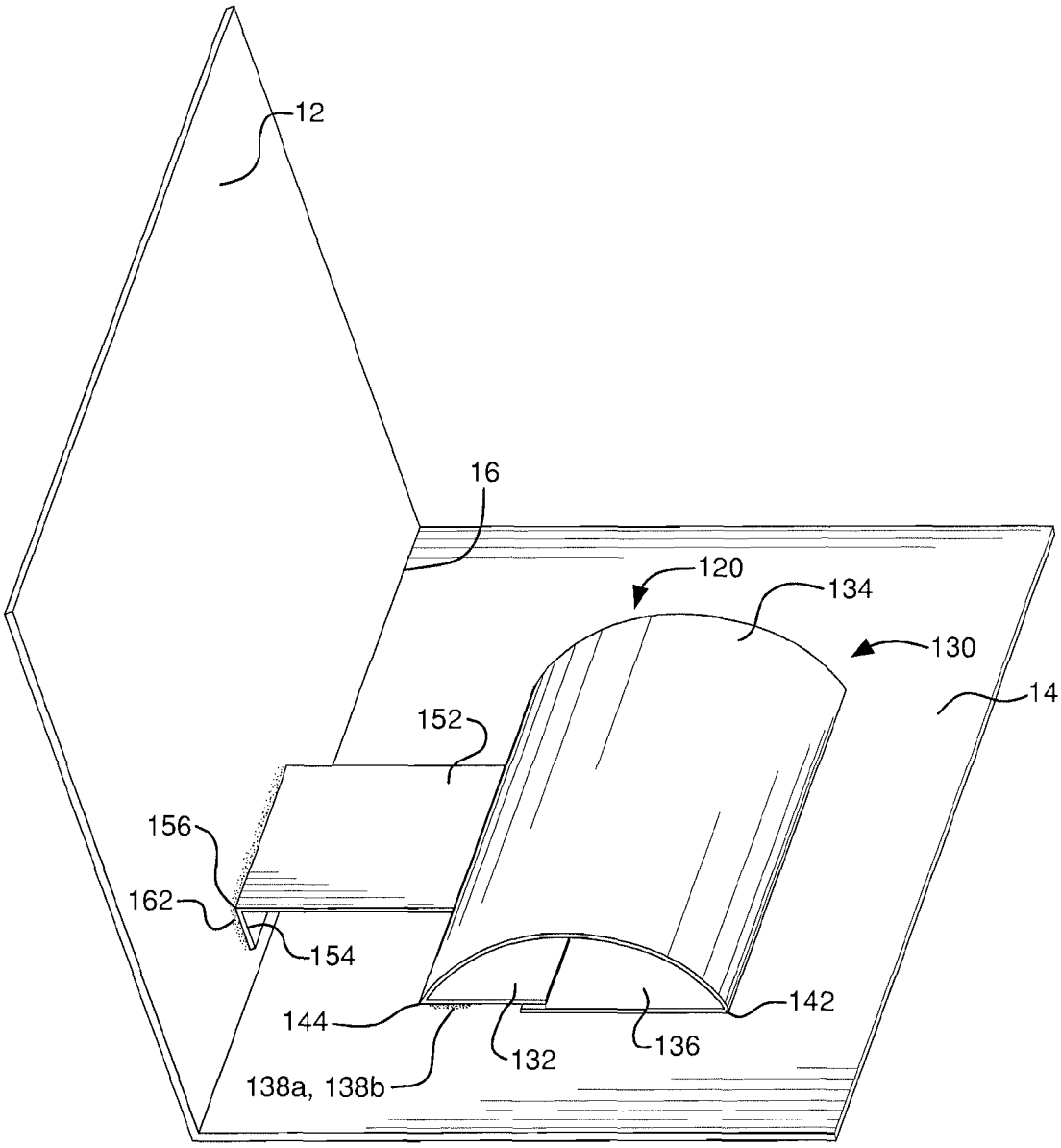
FIG. 9 shows a perspective view of a pop-up article made by a method of the present invention, in a partially open position.
Figure 10:
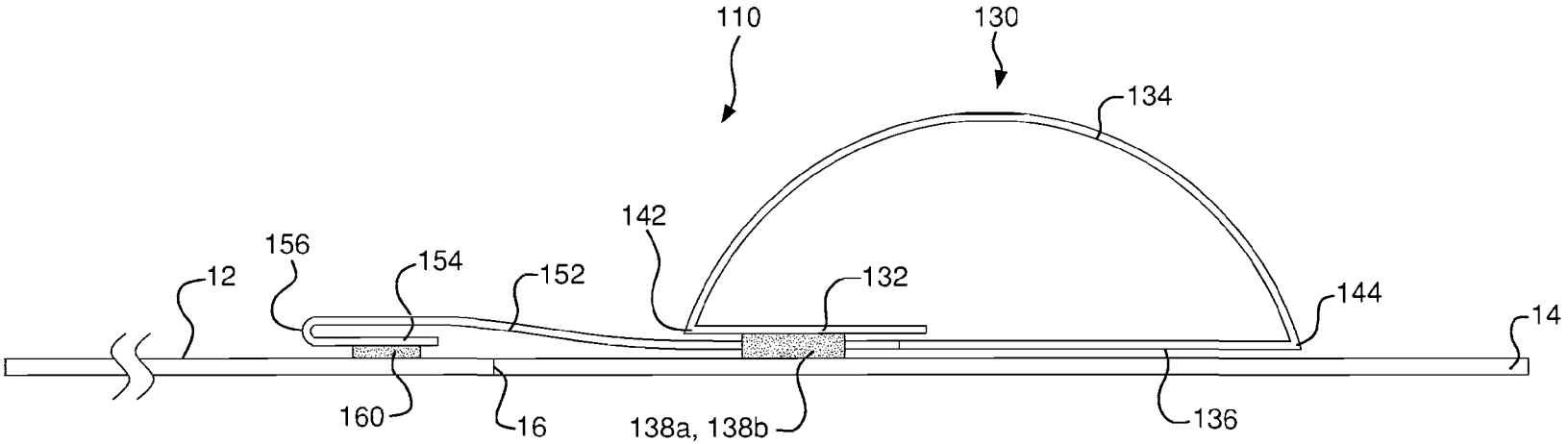
FIG. 10 shows a bottom side view of the pop-up article of FIG. 9, in a fully open position.
Figure 10A:
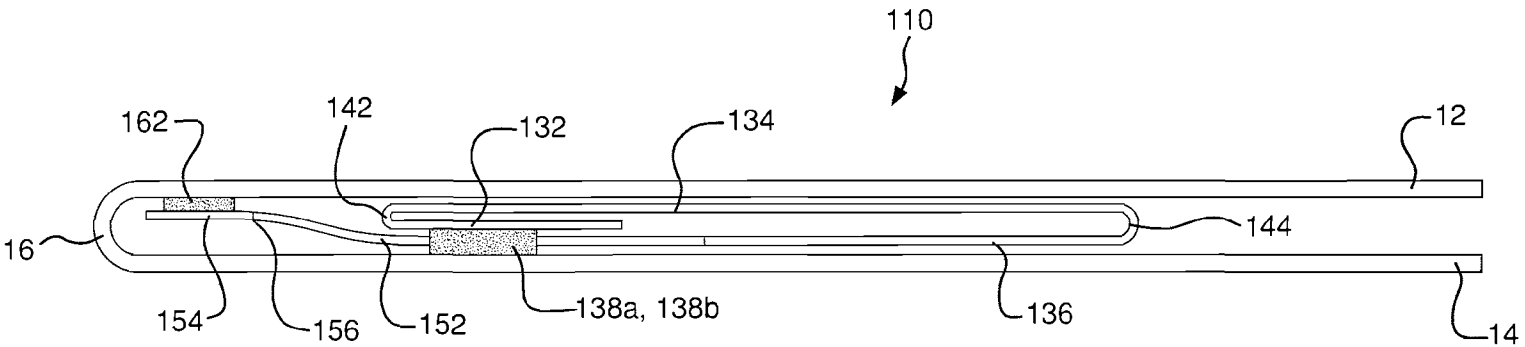
FIG. 10A shows a bottom side view of the pop-up article of FIG. 9, in a fully closed position.

An alternate pop-up device 120 made from a single piece of material is shown in FIGS. 9 through 10A, and a method of making the pop-up device 120 from a single web or ribbon is described with reference to FIGS. 11 through 11D.

Figure 11:
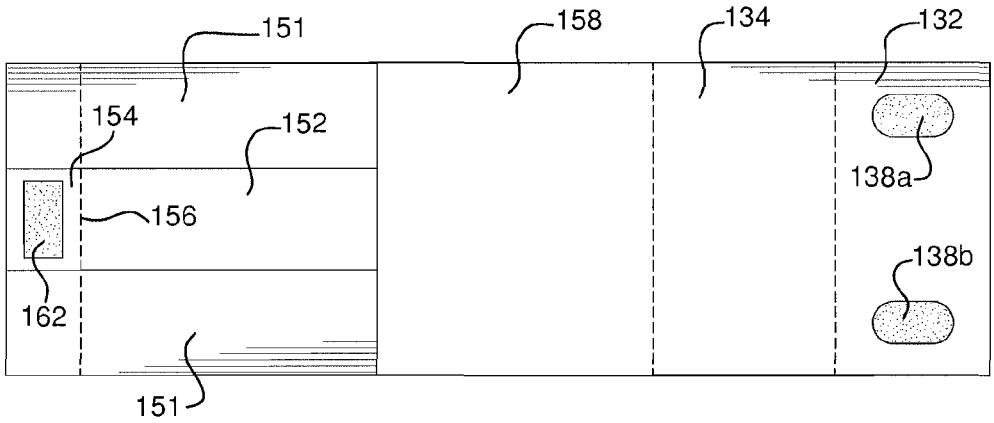
FIG. 11 shows a plan view of a web for making a pop-up device of the pop-up article of FIG. 9, indicating generally the location of slits, folds, and die cuts.

FIG. 11 generally depicts an overview of the processing operations to be performed on a second web 500 to make a pop-up device 120. As described above above, the second web 500 is fed from a splicer through an infeed into one or more printing units, the print is dried and the pigment is set, and varnish may be applied as desired. The web 500 is guided for further processing by one or more web guides. In describing the processing operations for making the pop-up device 120, reference is made to the sequential depictions of FIGS. 11A through 11C.

Figure 11A:
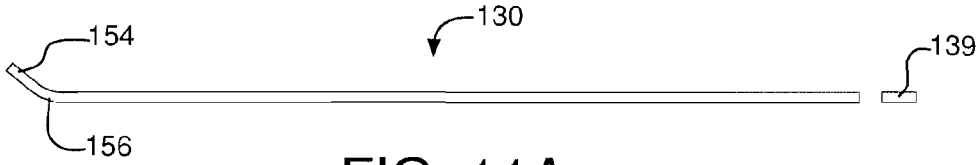
FIGS. 11A-11C show bottom end views of sequential method steps for making a pop-up device of the pop-up article of FIG. 9.

As shown in FIG. 11A, the web need not be slit apart other than to trim any excess material from the web, as for example a ribbon indicated by a portion 153 is trimmed away and discarded. The remaining ribbon is folded to create a fold 156, delineating a tab 154 at one end of the remaining ribbon.

Figure 11B:
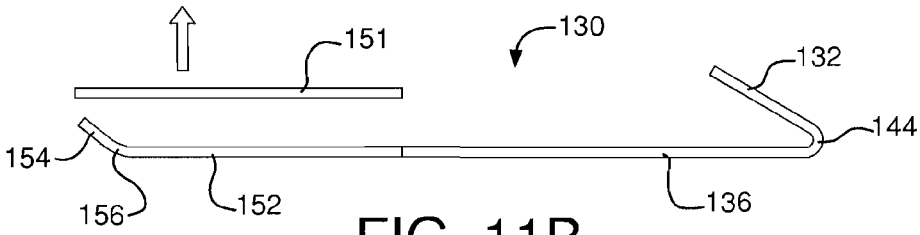

As shown in FIG. 11B, the remaining ribbon is further folded create a fold 144 delineating a pop-up portion 134 and a front flap 132. At the same time, a die cutter is used to repeatedly chip pieces 151 from the remaining ribbon to create a series of sliding portions 152 at intervals corresponding to individual pop-up devices 120.

Figure 11C:
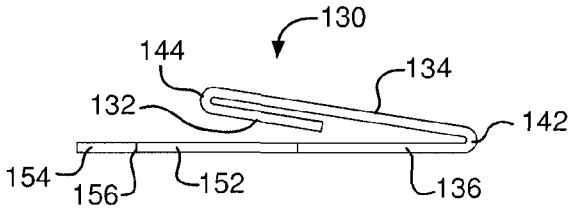

As shown in FIG. 11C, the remaining ribbon is further folded to create a fold 142 delineating the pop-up portion 134 and a rear flap 136, the rear flap 136 supporting the sliding portion 152.

Lastly, the individual pop-up device 120 is separated from the remaining ribbon, and each pop-up device 120 is synchronized and mated with a corresponding base piece 18, as described above with reference to FIGS. 8 and 8A.

In another method, the article 10 can be made from a single web which is divided into two or more ribbons, where one or two ribbons can be used to create the pop-up device 20, and one or more ribbons can be used to create the base piece 18 into which the pop-up device 20 is mounted.

It will be apparent to those skilled in the art that various modifications and variation can be made in the method and apparatus of the present invention without departing from the spirit or scope of the invention. Thus, it is intended that the present invention cover the modifications and variations of this invention provided they come within the scope of the appended claims and their equivalents.

What is claimed is:

1. A pop-up article comprising:

a base piece having a front cover and a back cover joined by a first fold;

a pop-up device having a pop-up panel, a front flap adjoining the pop-up panel at a second fold, and a rear flap adjoining the pop-up panel at a third fold, the rear flap supporting a sliding portion having a tab disposed distally from the pop-up panel;

wherein the tab is adhered to the front cover in proximity to the first fold, and wherein the front flap is adhered to the back cover, such that the pop-up panel forms a flat shape between the front and back covers when the base piece is closed with the front cover and the back cover generally parallel to each other, and the pop-up panel further forms a generally semi-cylindrical shape extending upwardly from the base piece when the base piece is opened with the front cover and the back cover generally aligned with each other.

2. The pop-up article of claim 1, wherein the base piece is configured as a booklet.

3. The pop-up article of claim 1, wherein at least one of the front cover and the back cover is made from a single ply.

4. The pop-up article of claim 1, wherein at least one of the front cover and the back cover comprises two or more plies.

5. The pop-up article of claim 1, wherein the sliding portion is narrower than the front flap.

6. The pop-up article of claim 1, wherein the sliding portion is disposed between the front flap and the back cover.

7. The pop-up article of claim 6, wherein the front flap is adhered to the back cover by adhesive disposed on either side of the sliding portion.

8. The pop-up article of claim 1, wherein the pop-up device is made from a single ribbon.

9. The pop-up article of claim 1, wherein the pop-up panel, the front flap, and the rear flap are made by processing a first ribbon, and the sliding portion is made by processing a second ribbon, the sliding portion comprising a fastening portion adhered to the rear flap.

10. The pop-up article of claim 9, the sliding portion further comprising an ornamental feature, the ornamental feature protruding outwardly from the pop-up device when the fastening portion is adhered to the rear flap.

11. The pop-up article of claim 10, wherein the ornamental feature is configured as a handle such that the pop-up device simulates a beverage mug when the back piece is opened.

12. The pop-up article of claim 1, wherein the pop-up device is narrower than the base piece.

13. The pop-up article of claim 1, wherein the tab is essentially coplanar with the sliding portion when the base piece is closed.

14. A pop-up article comprising:

a base piece having a front cover and a back cover joined by a first fold;

a pop-up device having a pop-up panel, a front flap adjoining the pop-up panel at a second fold, and a rear flap adjoining the pop-up panel at a third fold, the rear flap supporting a sliding portion having a tab disposed distally from the pop-up panel, the sliding portion being narrower than the front flap, the tab being adhered to the front cover in proximity to the first fold;

wherein the pop-up panel, the front flap, and the rear flap are made by processing a first ribbon, and the sliding portion is made by processing a second ribbon, the sliding portion comprising a fastening portion adhered to the rear flap such that the sliding portion is disposed between the front flap and the back cover; and wherein the front flap is adhered to the back cover by adhesive disposed on either side of the sliding portion such that the pop-up panel forms a flat shape between the front and back covers when the base piece is closed with the front cover and the back cover generally parallel to each other, and the pop-up panel further forms a generally semi-cylindrical shape extending upwardly from the base piece when the base piece is opened with the front cover and the back cover generally aligned with each other.

* * * * *